US006866728B2

(12) United States Patent
Kawazoe et al.

(10) Patent No.: US 6,866,728 B2
(45) Date of Patent: Mar. 15, 2005

(54) ALUMINUM ALLOY WITH EXCELLENT DECORATIVENESS

(75) Inventors: Masataka Kawazoe, Sendai (JP); Koichi Mikado, Sendai (JP); Hironobu Wakasa, Kurobe (JP); Futoshi Kozato, Namerikawa (JP); Yusuke Meiwa, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/770,521

(22) Filed: Feb. 4, 2004

(65) Prior Publication Data

US 2004/0163739 A1 Aug. 26, 2004

(30) Foreign Application Priority Data

Feb. 21, 2003 (JP) ..... 2003-043774

(51) Int. Cl.[7] ..... C22C 21/00
(52) U.S. Cl. ..... 148/440; 420/542; 420/543
(58) Field of Search ..... 148/440; 420/542, 420/543

(56) References Cited

U.S. PATENT DOCUMENTS 4,531,977 A 7/1985 Mishima et al.
5,469,605 A 11/1995 Horikawa
2003/0164207 A1 * 9/2003 Kashiwazaki et al. ..... 148/440

FOREIGN PATENT DOCUMENTS

JP 2587180 10/1998

OTHER PUBLICATIONS

Davis, J. R. "Aluminum and Aluminum Alloys" ASM International, Materials Park, OH, p. 674, col. 3, paragraph 3, p. 677, col. 1; p. 674, paragraph 5.
European Search Report dated Apr. 29, 2004 for Application EP 04 25 0939.

* cited by examiner

*Primary Examiner*—George Wyszomierski
*Assistant Examiner*—Janelle Morillo
(74) *Attorney, Agent, or Firm*—Finnegan, Henderson, Farabow, Garrett, & Dunner, L.L.P.

(57) ABSTRACT

An aluminum alloy with excellent decorativeness, having a composition represented by the general formula $Al_aMg_bMn_cCr_d$, wherein b, c, and d are, in mass percentage, $3.0 \leqq b \leqq 5.6$, $0.05 \leqq c \leqq 1.0$, $0.05 \leqq d \leqq 0.7$, $c+d>0.2$, and a is the balance with unavoidable impurity elements possibly being contained, wherein a matrix of the aluminum alloy is a structure substantially composed of an aluminum solid solution, in which no β-phase is present. This alloy has excellent decorativeness and decorativeness as well as superior strength, hardness and other such mechanical properties and is useful as materials for slide fastener constituent members, such as their elements, stops, and sliders, and/or in snap buttons, ordinary buttons, and clasps.

10 Claims, 3 Drawing Sheets

ALUMINUM ALLOY WITH EXCELLENT DECORATIVENESS

BACKGROUND OF THE INVENTION

1. Field of the Invention

The present invention relates to an aluminum alloy with excellent decorativeness, which is used, for example, for slide fastener constituent members, such as the elements, stoppers, slider, and pull tab of a slide fastener, and for fastener products such as snap buttons, ordinary buttons, and various types of clasps.

2. Description of the Prior Art

The slide fastener constituent members, for example, have up to now mainly been made of copper alloys, including red brass, brass, and other such copper-zinc alloys, and nickel silver and other such copper-zinc-nickel alloys. The color of these alloys, be it copper color, gold color, or silver color, is determined by the materials used. The applications in which slide fasteners have been used in recent years have required them to have an aesthetically pleasing appearance, so there has been a need for slide fastener constituent members of various colors.

A slide fastener of various colors has been disclosed, for example, in Japanese Utility Model Registration No. 2587180, in which elements (teeth) composed of aluminum or an alloy thereof are subjected to anodizing, electroplating, electrodeposition, or another such electrochemical surface treatment.

However, when an existing aluminum alloy (such as JIS 5183) is subjected to an electrochemical surface treatment, the resulting slide fastener elements of various colors tend to have poor metallic gloss, and when the alloy composition is adjusted or when an existing aluminum alloy (such as JIS 5052, 5056, or 5154) is selected so as to emphasize metallic gloss, the mechanical properties, particularly strength, required by the application, and are compromised, so there are practical limitations to this approach.

SUMMARY OF THE INVENTION

In view of this, it is an object of the present invention to provide an aluminum alloy with excellent decorativeness, which has the strength, hardness, and other such mechanical properties required by the intended application, and which also has excellent metallic gloss.

The present invention is constituted as follows.

(1) An aluminum alloy with excellent decorativeness, having a composition represented by the general formula $Al_aMg_bMn_cCr_d$, wherein b, c, and d are, in mass percentage, $3.0 \leqq b \leqq 5.6$, $0.05 \leqq c \leqq 1.0$, $0.05 \leqq d \leqq 0.7$, $c+d>0.2$, and a is the balance with unavoidable impurity elements possibly being contained, wherein a matrix of the aluminum alloy is a structure substantially composed of an aluminum solid solution, in which no β-phase is present.

(2) The aluminum alloy with excellent decorativeness according to (1) above, wherein b, c, and d are, in mass percentage, $4.3 \leqq b \leqq 5.2$, $0.05 \leqq c \leqq 0.7$, $0.05 \leqq d \leqq 0.5$, and $c+d>0.2$.

(3) The aluminum alloy with excellent decorativeness according to (2) above, wherein b, c, and d are, in mass percentage, $4.5 \leqq b \leqq 5.0$, $0.2 \leqq c \leqq 0.7$, $0.1 \leqq d \leqq 0.3$, and $c+d>0.2$.

(4) The aluminum alloy with excellent decorativeness according to any of (1) to (3), wherein $c+3.2d \leqq 1.25$.

(5) The aluminum alloy with excellent decorativeness according to any of (1) to (4) above, wherein the aluminum alloy contains no compound having a particle size of greater than 5 μm.

(6) The aluminum alloy with excellent decorativeness according to any of (1) to (4) above, wherein the aluminum alloy contains a compound having an average particle size of 200 nm to 5 μm and a precipitate having a particle size of no more than 100 nm.

(7) The aluminum alloy with excellent decorativeness according to any of (1) to (6) above, wherein an anodic oxide film formed on the aluminum alloy by anodizing has a lightness of at least 55, as indicated by an L* value, which is a lightness defined in JIS Z 8729.

(8) The aluminum alloy with excellent decorativeness according to any of (1) to (7) above, wherein the aluminum alloy has a hardness Hv of at least 125.

(9) The aluminum alloy with excellent decorativeness according to any of (1) to (8), wherein the aluminum alloy has a cold workability of at least 55% in terms of fractional reduction in cold upsetting height.

(10) An aluminum alloy with excellent decorativeness, wherein the alloy according to any of (1) to (9) above is used for at least one slide fastener constituent member selected from the group consisting of elements, stoppers, a pull tab, and a slider.

(11) An aluminum alloy with excellent decorativeness, wherein the alloy according to any of (1) to (9) above is used for at least one selected from the group consisting of snap buttons, ordinary buttons, and clasps.

DETAILED DESCRIPTION OF THE PREFERRED EMBODIMENTS

Figure 1:
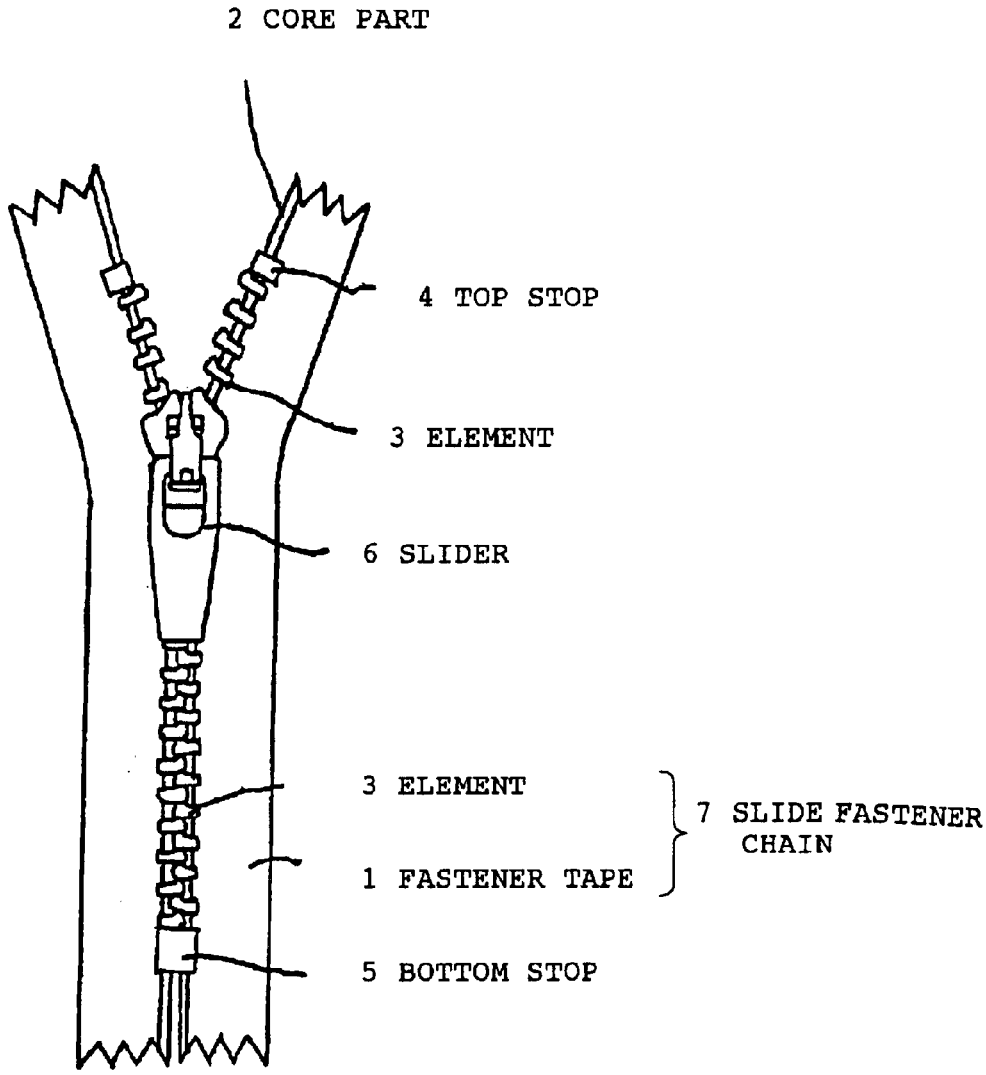
FIG. 1 is a conceptual diagram of a slide fastener.

The aluminum alloy for a slide fastener to which the present invention is applied will now be described.

In the present invention, the above-mentioned object can be achieved by using the composition expressed by the above general formula.

Mg has an effect in enhancing the mechanical properties (strength and hardness) of the alloy by forming a solid solution in the aluminum matrix. The mechanical properties (strength and hardness) will be inadequate if the Mg content is below the above-mentioned lower limit (3.0 mass %). If Mg content is above the upper limit (5.6 mass %), a β-phase will be formed in the (continuous) casting step, and when an electrochemical surface treatment is performed, the metallic gloss will be lost, which leads to a decrease in decorativeness. Even better mechanical properties and metallic gloss can be achieved if the Mg content range is 4.3 to 5.2 mass %. The effect will be even more pronounced if the range is 4.5 to 5.0 mass %.

Mn has an effect in enhancing the mechanical properties (strength and hardness) of the alloy by being precipitated from the aluminum matrix. The mechanical properties (strength and hardness) will be inadequate if the Mn content is below the above-mentioned lower limit (0.05 mass %). If the Mn content is above the upper limit (1.0 mass %), when the electrochemical surface treatment is performed, metallic gloss will be lost, which leads to a decrease in decorative properties, and cold workability may be inadequate. Even better mechanical properties can be achieved if the Mn content range is 0.05 to 0.7 mass %. The effect will be even more pronounced if the range is 0.2 to 0.7 mass %.

Cr has an effect in enhancing the mechanical properties (strength and hardness) of the alloy by being precipitated from the aluminum matrix. The mechanical properties (strength and hardness) will be inadequate if the Cr content is below the above-mentioned lower limit (0.05 mass %). If the Cr content is above the upper limit (0.7 mass %), cold workability may be inadequate. Even better mechanical properties and cold workability can be achieved if the Cr content range is 0.05 to 0.5 mass %. The effect will be even more pronounced if the range is 0.1 to 0.3 mass %.

The combined amount of Mn and Cr must be greater than 0.2% in order to produce a structure in which fine compounds or precipitates are present and to increase hardness and strength. The increase in hardness and strength will be even more pronounced if the combined amount is at least 0.3%. It is preferable for the amounts in which Mn and Cr are added to be such that the amount of Mn plus 3.2 times the amount of Cr is less than or equal to 1.25, that is, $c+3.2d \leqq 1.25$, because the precipitation of very large crystals will be suppressed, and workability, and especially workability after continuous casting, will be improved.

Al, which accounts for the balance of the above-defined general formula, may be partially replaced with iron, silicon, or the like without any problem whatsoever in terms of alloy characteristics, and an alloy having the characteristics targeted by the present invention can be provided in this way.

If the matrix of the alloy of the present invention is a structure substantially composed of a solid solution of aluminum, in which no β-phase is present, then an alloy with good metallic gloss can be obtained even after electrochemical surface treatment, and this alloy will also have excellent corrosion resistance and stress corrosion resistance. An alloy that also has excellent mechanical properties can be obtained by dissolving various elements in the solid solution of the aluminum matrix.

It is undesirable for the aluminum alloy to include compounds having a particle size of more than 5 μm because adequate hot and cold workability after continuous casting cannot be ensured. It is desirable for there to be compounds with an average particle size of 200 nm to 5 μm and precipitates of no more than 100 nm because mechanical properties (strength and hardness) can be improved while maintaining metallic gloss. More specifically, the matrix is a structure substantially composed of an aluminum solid solution, and Al—(Fe, Mn, and/or Cr)-based compounds are present along with the above-mentioned aluminum solid solution.

In terms of metallic gloss, it is preferable for the alloy of the present invention to have an L* value of at least 55 on the basis of the chromaticity diagram of the L*a*b* Colorimetric System specified in JIS Z 8729.

The coloring referred to in this Specification is indicated by the lightness index L* (lightness: L star), chromatic index a* (greenish to reddish: a star), and b* (bluish to yellowish: b star) expressed by the method for indicating the color of objects set forth in JIS Z 8729.

An alloy that can be effectively applied as materials for slide fastener constituent members, snap buttons, ordinary buttons, or various types of clasps, for example, can be provided by adjusting the hardness to an Hv of at least 125 and a cold workability of at least 55% as a fractional reduction in cold upsetting height.

A slide fastener, which is an application of the alloy of the present invention, will now be described in specific terms through reference to the drawings.

FIG. 1 is a conceptual diagram of a slide fastener. As shown in FIG. 1, a slide fastener comprises a pair of fastener tapes 1 each having a core part 2 formed along one edge, elements 3 fixed (mounted) at regular intervals along the core parts 2 of the fastener tapes 1, a top stop 4 and bottom stop 5 fixed onto the core parts 2 of the fastener tapes 1 at the top and bottom ends of the rows of the elements 3, and a slider 6 disposed between the opposing elements 3 and able to slide up and down in order to engage and separate the elements 3. A slide fastener chain 7 is constituted by mounting the elements 3 on the core parts 2 of the fastener tapes 1. Although not shown in the drawing, the slider 6 shown in FIG. 1 is produced by subjecting a long material plate with a rectangular cross section to multi-stage pressing, and cutting this product at specific intervals to produce a slider body, then mounting a spring and pull tab as necessary. The pull tab is produced by punching out a desired shape from the plate with a rectangular cross section, then fixing this onto the slider body. The bottom stop may consist of a separable insertion device composed of an insertion pin, a box pin, a box body, and, so that the pair of slide fastener chains can be separated by the opening operation of the slider.

Figure 2:
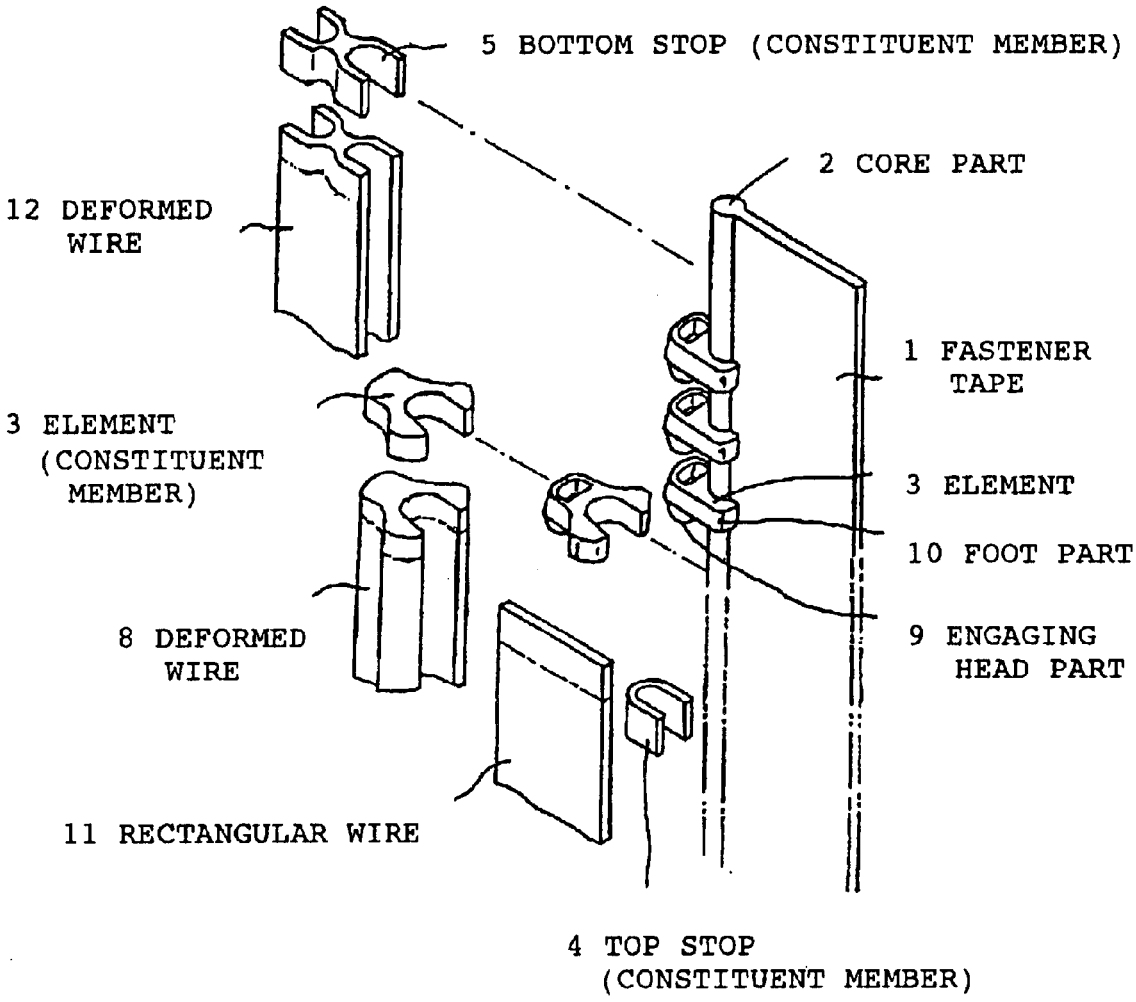
FIG. 2 is a diagram illustrating how the slide fastener in FIG. 1 is manufactured.

FIG. 2 is a diagram illustrating how the elements 3, the top stop 4 and bottom stop 5 of the slide fastener shown in FIG. 1 are manufactured and how they are attached to the core part 2 of the fastener tape 1. As shown, the elements 3 are produced by cutting at specific intervals a deformed wire 8 having an approximately Y-shaped cross section, press-molding these to form engaging head parts 9, and then fixing foot parts 10 onto the core part 2 of the fastener tape 1 containing conductive wires as described in Japanese Utility Model Registration No. 2587180. The elements 3 can also be produced by forming the engaging head parts 9 in rectangular strip (straight angle strip) with a rectangular cross section, punching out [the desired shapes], and mounting these by fixing the foot parts 10 onto the core part 2 of the fastener tape 1 containing conductive wires. The above-mentioned top stop is produced by cutting at specific intervals a rectangular wire (straight angle wire) 11 with a rectangular cross section, bending these into pieces with an approximately U-shaped cross section, and then fixing them onto the core part 2 of the fastener tape 1. The bottom stop is produced by cutting at specific intervals a deformed wire 12 having an approximately X-shaped cross section, and then fixing these onto the core part 2 of the fastener tape 1. In the drawing, the elements 3 and the top and bottom stops 4 and 5 are mounted simultaneously on the fastener tape 1, but in actual practice, the elements 3 are attached continuously to the fastener tape 1 to first produce a fastener chain 7, and then the elements 3 are removed from the area of the fastener chain where the stops are to be attached, and the stop 4 or 5 is mounted near the elements 3 in this area.

In the manufacture and attachment described above, the elements, stops, slider, pull tab, and other such constituent members of the slide fastener must be made from an alloy with excellent cold workability.

Also, with a slide fastener containing conductive wires, anodizing, electroplating, electrodeposition, or other such electrochemical surface treatments are performed by placing the slide fastener in a treatment bath and passing an electric current through the conductive wires to the elements. When a deformed wire 8 having an approximately Y-shaped cross section is used for preparing the elements, the deformed wire may be subjected to the electrochemical surface treatment in the state of a wire form, and then formed into the elements 3. The elements are mounted by fixing the foot parts 10 onto the core part 2 of the fastener tape 1. When the engaging head parts 9 are formed in a rectangular wire (straight angle wire) with a rectangular cross section, and this wire is punched out to produce the elements, numerous elements may be mounted in a jig, subjected to an electrochemical surface treatment, and then mounted by fixing the foot parts 10 onto the core part 2 of the fastener tape 1.

As to the specific method and apparatus for performing the anodizing, electroplating, electrodeposition, or other such electrochemical surface treatments, the continuous treatment described in Japanese Patent Application 2001-399610, previously filed by the present applicant, is particularly effective, for example. Specifically, using an apparatus in which a first electrode plate electrically connected directly by an external power supply is placed in electrolyte in a first-stage electrolytic bath, and a plurality of power supplies are provided for passing an electric current between adjacent pair of electrode plates disposed in second- and subsequent stage electrolytic bath, for example, a fastener chain is successively wound around a plurality of rollers, an electric current is passed directly to an element row from the external power supply through the conductive wires in the fastener chain, and an electric current is passed from the power supplies to the second and subsequent pairs of electrode plates in the bath. This method keeps the anodic oxide film uniform and allows this film to be formed stably and uniformly in the desired thickness, and employing the alloy of the present invention produces a product that has an excellent metallic gloss because of the high lightness L* value, and that has stable coloring with no color unevenness or other color problems.

Figure 3:
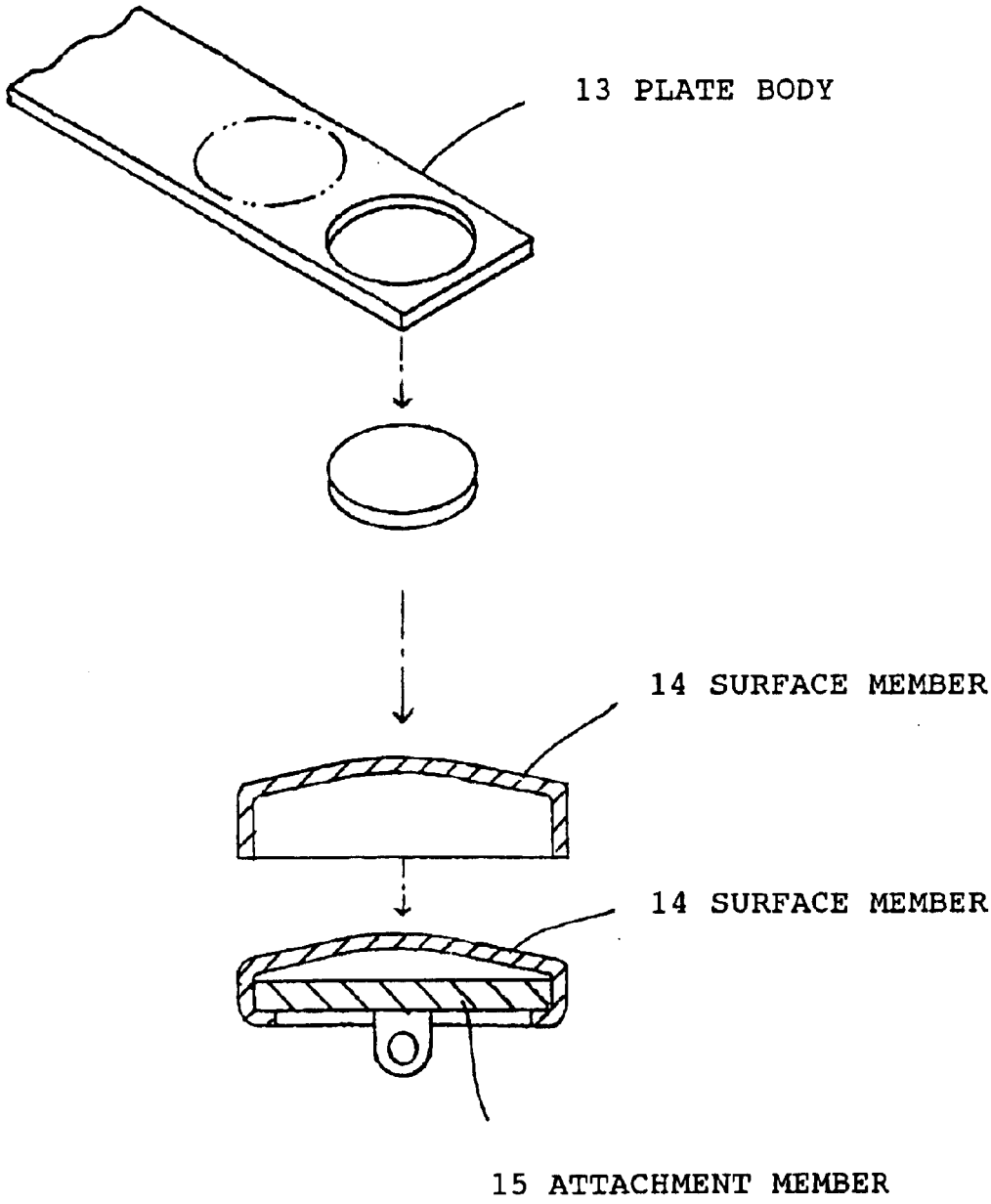
FIG. 3 is a diagram illustrating how a button is manufactured.

FIG. 3 is a diagram illustrating how buttons are manufactured. As shown in FIG. 3, a strip composed of a plate body 13 with a rectangular cross section is punched out in the desired shape, and this is press-molded to form a surface member 14 of a button as shown in the drawing. The surface member of the button is fixed to the attachment member 15 of the button as shown in the drawing, and this product is sewn to clothing or a tape. The above-mentioned button can also be produced by subjecting a strip composed of the plate body 13 with a rectangular cross section to an electrochemical surface treatment, then punching, press-molding, and fixing to the attachment member. The same applies to a snap button, with which the electrochemical surface treatment is performed on a member corresponding to the above-mentioned surface member.

This process can also be applied to shoe fasteners, metal adjusters for belts, and clasps such as hook and eye fasteners.

The present invention will now be described in specific terms through reference to examples, but the present invention is not limited to or by the following examples.

EXAMPLE 1

A billet (40 mm diameter) of an aluminum alloy having the composition shown in the left column of Table 1 was cast, and this billet was homogenized, after which direct extrusion was performed with a extruder to produce an extruded rod with a diameter of 8 mm. This extruded rod was used as a test material and evaluated for cold workability. Also, this extruded rod was rolled at room temperature to a thickness of 1.36 mm and annealed, after which it was rolled at room temperature to 0.22 mm, and then evaluated for hardness and the color tone of an alumite film (anodic oxide film) according to the standards given below. Also, the compositions given in the left column of Table 1 were continuously cast and evaluated for hot workability by hot rolling immediately after the casting. The same evaluations were made for conventional materials (comparative materials).

These results are given in the right columns of Table 1.

TABLE 1

| | Al alloy composition (mass %) | | | | | Hardness | | Cold workability | | L* value | | Hot workability | | Overall |
|---|---|---|---|---|---|---|---|---|---|---|---|---|---|---|
| No.*1 | Al | Mg | Mn | Cr | Other*2 | Measured value | Evaluation | Measured value | Evaluation | Measured value | Evaluation | Measured value | Evaluation | evaluation |
| PI 1 | bal. | 3.8 | 0.2 | 0.1 | imp. | 120 | Δ | 77% | ○ | 83 | ○ | 5 | ○ | ○ |
| PI 2 | " | 3.8 | 0.6 | 0.1 | " | 126 | ○ | 57% | ○ | 73 | ○ | 10 | ○ | ⊕ |
| PI 3 | " | 3.8 | 0.1 | 0.2 | " | 120 | Δ | 77% | ○ | 80 | ○ | 5 | ○ | ○ |
| PI 4 | " | 3.8 | 0.6 | 0.2 | " | 128 | ○ | 57% | ○ | 73 | ○ | 20 | ○ | ⊕ |
| PI 5 | " | 3.8 | 0.3 | 0.25 | " | 124 | Δ | 67% | ○ | 77 | ○ | 18 | ○ | ○ |
| PI 6 | " | 3.8 | 0.1 | 0.6 | " | 120 | Δ | 60% | ○ | 82 | ○ | 53 | Δ | ○ |

TABLE 1-continued

| | Al alloy composition (mass %) | | | | | Hardness | | Cold workability | | L* value | | Hot workability | | Overall |
|---|---|---|---|---|---|---|---|---|---|---|---|---|---|---|
| No.*1 | Al | Mg | Mn | Cr | Other*2 | Measured value | Evaluation | Measured value | Evaluation | Measured value | Evaluation | Measured value | Evaluation | evaluation |
| PI 7 | " | 3.8 | 0.2 | 0.6 | " | 121 | Δ | 57% | ○ | 84 | ○ | 55 | Δ | ○ |
| PI 8 | " | 4.3 | 0.2 | 0.1 | " | 122 | Δ | 76% | ○ | 81 | ○ | 5 | ○ | ○ |
| PI 9 | " | 4.3 | 0.6 | 0.1 | " | 131 | ○ | 56% | ○ | 71 | ○ | 11 | ○ | ⊕ |
| PI 10 | " | 4.3 | 0.1 | 0.2 | " | 122 | Δ | 76% | ○ | 79 | ○ | 5 | ○ | ○ |
| PI 11 | " | 4.3 | 0.6 | 0.2 | " | 133 | ○ | 56% | ○ | 71 | ○ | 22 | ○ | ⊕ |
| PI 12 | " | 4.3 | 0.3 | 0.25 | " | 129 | ○ | 66% | ○ | 74 | ○ | 15 | ○ | ⊕ |
| PI 13 | " | 4.3 | 0.1 | 0.6 | " | 123 | Δ | 59% | ○ | 79 | ○ | 54 | Δ | ○ |
| PI 14 | " | 4.3 | 0.2 | 0.6 | " | 126 | ○ | 56% | ○ | 81 | ○ | 57 | Δ | ○ |
| PI 15 | " | 4.5 | 0.2 | 0.1 | " | 125 | ○ | 75% | ○ | 81 | ○ | 5 | ○ | ⊕ |
| PI 16 | " | 4.5 | 0.6 | 0.1 | " | 133 | ○ | 56% | ○ | 72 | ○ | 13 | ○ | ⊕ |
| PI 17 | " | 4.5 | 0.1 | 0.2 | " | 126 | ○ | 75% | ○ | 80 | ○ | 5 | ○ | ⊕ |
| PI 18 | " | 4.5 | 0.6 | 0.2 | " | 135 | ○ | 56% | ○ | 71 | ○ | 21 | ○ | ⊕ |
| PI 19 | " | 4.5 | 0.3 | 0.25 | " | 131 | ○ | 65% | ○ | 74 | ○ | 17 | ○ | ⊕ |
| PI 20 | " | 4.5 | 0.1 | 0.6 | " | 125 | ○ | 58% | ○ | 79 | ○ | 55 | Δ | ○ |
| PI 21 | " | 4.5 | 0.2 | 0.6 | " | 128 | ○ | 56% | ○ | 80 | ○ | 58 | Δ | ○ |
| PI 22 | bal. | 4.8 | 0.2 | 0.1 | imp. | 126 | ○ | 75% | ○ | 80 | ○ | 5 | ○ | ⊕ |
| PI 23 | " | 4.8 | 0.6 | 0.1 | " | 136 | ○ | 56% | ○ | 70 | ○ | 15 | ○ | ⊕ |
| PI 24 | " | 4.8 | 0.1 | 0.2 | " | 126 | ○ | 75% | ○ | 80 | ○ | 5 | ○ | ⊕ |
| PI 25 | " | 4.8 | 0.6 | 0.2 | " | 138 | ○ | 55% | ○ | 70 | ○ | 22 | ○ | ⊕ |
| PI 26 | " | 4.8 | 0.3 | 0.25 | " | 134 | ○ | 65% | ○ | 75 | ○ | 18 | ○ | ⊕ |
| PI 27 | " | 4.8 | 0.1 | 0.6 | " | 128 | ○ | 58% | ○ | 80 | ○ | 57 | Δ | ○ |
| PI 28 | " | 4.8 | 0.2 | 0.6 | " | 131 | ○ | 55% | ○ | 80 | ○ | 59 | Δ | ○ |
| PI 29 | " | 5.0 | 0.2 | 0.1 | " | 127 | ○ | 75% | ○ | 79 | ○ | 6 | ○ | ⊕ |
| PI 30 | " | 5.0 | 0.6 | 0.1 | " | 138 | ○ | 55% | ○ | 68 | ○ | 15 | ○ | ⊕ |
| PI 31 | " | 5.0 | 0.1 | 0.2 | " | 128 | ○ | 75% | ○ | 78 | ○ | 5 | ○ | ⊕ |
| PI 32 | " | 5.0 | 0.6 | 0.2 | " | 140 | ○ | 55% | ○ | 68 | ○ | 23 | ○ | ⊕ |
| PI 33 | " | 5.0 | 0.3 | 0.25 | " | 136 | ○ | 60% | ○ | 73 | ○ | 16 | ○ | ⊕ |
| PI 34 | " | 5.0 | 0.1 | 0.6 | " | 130 | ○ | 58% | ○ | 78 | ○ | 59 | Δ | ○ |
| PI 35 | " | 5.0 | 0.2 | 0.6 | " | 133 | ○ | 55% | ○ | 79 | ○ | 58 | Δ | ○ |
| PI 36 | " | 5.2 | 0.2 | 0.1 | " | 129 | ○ | 74% | ○ | 72 | ○ | 6 | ○ | ⊕ |
| PI 37 | " | 5.2 | 0.6 | 0.1 | " | 140 | ○ | 54% | Δ | 62 | ○ | 17 | ○ | ○ |
| PI 38 | " | 5.2 | 0.1 | 0.2 | " | 130 | ○ | 74% | ○ | 72 | ○ | 5 | ○ | ⊕ |
| PI 39 | " | 5.2 | 0.6 | 0.2 | " | 142 | ○ | 54% | Δ | 62 | ○ | 23 | ○ | ○ |
| PI 40 | " | 5.2 | 0.3 | 0.25 | " | 138 | ○ | 57% | ○ | 68 | ○ | 15 | ○ | ⊕ |
| PI 41 | " | 5.2 | 0.1 | 0.6 | " | 132 | ○ | 57% | ○ | 72 | ○ | 59 | Δ | ○ |
| PI 42 | " | 5.2 | 0.2 | 0.6 | " | 135 | ○ | 52% | Δ | 72 | ○ | 59 | Δ | ○ |
| PI 43 | bal. | 5.4 | 0.2 | 0.1 | imp. | 131 | ○ | 72% | ○ | 70 | ○ | 6 | ○ | ⊕ |
| PI 44 | " | 5.4 | 0.6 | 0.1 | " | 142 | ○ | 52% | Δ | 60 | ○ | 18 | ○ | ○ |
| PI 45 | " | 5.4 | 0.1 | 0.2 | " | 132 | ○ | 72% | ○ | 70 | ○ | 5 | ○ | ⊕ |
| PI 46 | " | 5.4 | 0.6 | 0.2 | " | 144 | ○ | 52% | Δ | 60 | ○ | 25 | ○ | ○ |
| PI 47 | " | 5.4 | 0.3 | 0.25 | " | 140 | ○ | 54% | Δ | 65 | ○ | 18 | ○ | ○ |
| PI 48 | " | 5.4 | 0.1 | 0.6 | " | 134 | ○ | 55% | ○ | 70 | ○ | 58 | Δ | ○ |
| PI 49 | " | 5.4 | 0.2 | 0.6 | " | 137 | ○ | 50% | Δ | 70 | ○ | 60 | Δ | ○ |
| CM 1 (5052) | bal. | 2.5 | — | 0.2 | imp. | 105 | X | 75% | ○ | 80 | ○ | 5 | ○ | X |
| CM 2 (5154) | " | 3.5 | — | 0.2 | " | 115 | X | 75% | ○ | 80 | ○ | 5 | ○ | X |
| CM 3 (5056) | " | 4.8 | 0.1 | 0.1 | " | 119 | X | 75% | ○ | 79 | ○ | 5 | ○ | X |
| CM 4 (5183) | " | 5 | 0.8 | — | " | 139 | ○ | 48% | X | 52 | X | 45 | ○ | X |
| CM 5 (FF58) | " | 5.8 | — | — | Cu: 0.3 | 135 | ○ | 70% | ○ | 50 | X | 110 | X | X |

Note:
*1 PI: Present invention material; CM: Comparative material; bal: balance
*2 imp: impurity Evaluation of the measured results shown in Table 1 are as follows:

1. Hardness

The face of a cold-rolled material perpendicular to the rolling direction was mechanically polished to a mirror finish to produce an evaluation sample. The hardness was measured with a micro-Vickers hardness gauge under a load of 50 gf.

○: Hv at least 125

Δ: Hv at least 120, less than 125 x: Hv less than 120

2. Cold Workability

Each test piece measuring 6 mm in diameter and 9 mm height was produced on a lathe from an extruded material, and this was used for the evaluation sample. This was placed between metal molds having a smooth face, a compression test by upsetting was conducted to a certain reduction in height, and the sample was checked for cracking under an optical microscope. The highest reduction in height at which no cracking occurred was termed the workable limit. The symbols used for evaluation correspond to the following workable limits, respectively.

○: at least 55%

Δ: at least 50%, less than 50% x: less than 50%

3. L* Value (Color Tone of Alumite Film)

The roll-contact face of a cold-rolled material perpendicular to the rolling direction was mechanically polished to a mirror finish to produce an evaluation sample. The sample was degreased, after which it was subjected to anodizing using 2 mol/L sulfuric acid as an electrolytic bath, and with the bath temperature, voltage, and time set so as to form a film 20 μm thick on the sample surface. After this anodizing, the L* value was measured with a colorimeter.

○: L* value at least 55 x: L* value less than 55

4. Hot Workability

A wire was fabricated by continuous casting, and the wire thus obtained was subjected to hot rolling to produce a fine wire. After being adjusted to the desired shape, this wire was finally wound on a winder.

A defectoscope was set up ahead of the winder, and the surface defects (at least 1 mm large) on the wire adjusted to the desired shape as above were counted.

○: fewer than 50 defects

Δ: at least 50 defects, fewer than 100 x: at least 100 defects

5. Overall Evaluation

The above-mentioned cold workability, hardness, L* value (color tone of alumite film), and hot workability were given an overall evaluation, the results of which are given in the right column of Table 1.

⊕: the evaluations for cold workability, hardness, alumite film coloring, and hot workability were all ○

○: the evaluations for cold workability, hardness, alumite film coloring, and hot workability were all ○ or Δ x: the evaluations for cold workability, hardness, alumite film coloring, and hot workability included x 6. Texture Observation Present invention materials 1 to 49 were observed by TEM (transmission electron microscope). With all of present invention materials 1 to 49, the matrix was a structure substantially composed of an aluminum solid solution in which no β-phase was present. Furthermore, in this structure there was no compound whose particle size was over 5 μm in any of the present invention materials, there was an Al—(Fe,Mn,Cr)-based compound whose average particle size was 200 nm to 5 μm, and there were Al—Mn-based and/or Al—Cr-based precipitates of 100 nm or less.

Table 1 shows that the effect on hardness was small in present invention material Nos. 1, 3, 5-8, 10, and 13 because of the work-hardening caused by Mg and because of a small amount of fine compounds. Cold workability was inferior in present invention material Nos. 37, 39, 42, 44, 46, 47, and 49 because work-hardening caused by Mg and because too many fine compounds were dispersed. Hot workability was inferior in present invention material Nos. 6, 7, 13, 14, 20, 21, 27, 28, 34, 35, 41, 42, 48, and 49 because large crystals precipitated during the continuous casting. The effect on hardness was small in comparative material Nos. 1, 2, and 3 because the amount of added Mg, Mn, or Cr was small. The cold workability was inferior in comparative material No. 4 because too many fine compounds were dispersed. The L* value was also inferior because of a large amount of residual compounds in the alumite film after anodizing. When the sample was produced by continuous casting in comparative material No. 5, the Mg distribution was uneven, which hindered anodizing. Also, there were numerous surface defects because thermal embrittlement cracking tended to occur in hot rolling.

It is clear from the above that the present invention materials had better hardness, cold workability, and L* values than the conventional materials (comparative materials).

EXAMPLE 2

The fastener parts shown in FIGS. 1 and 2 were produced by subjecting the continuously cast material of present invention material 25 to cold working, annealing, and deformation-rolling. As shown in Table 2, the fastener strength was better than that of one of the conventional materials. Also, the anodic oxide film was transparent and had a high L* value, so it could be dyed to achieve an excellent decorative appearance. The comparative material whose strength was the same as that of the present invention material had a low L* value, and therefore had inferior decorative properties. The F strength is the result of measuring the element pull-out strength for elements that have been fixed to a fastener tape.

TABLE 2

| | Al alloy composition (mass %) | | | | | F | L* | | |
|---|---|---|---|---|---|---|---|---|---|
| No. | Al | Mg | Mn | Cr | Other | strength | value | Decorativeness | Evaluation |
| Present invention material 25 | balance | 4.8 | 0.6 | 0.2 | impurity | 6 kgf | 62 | ○ | ○ |
| Comparative material 3 | balance | 4.8 | 0.1 | 0.1 | impurity | 5 kgf | 62 | ○ | X |
| Comparative material 5 | balance | 5.8 | — | — | Cu: 0.3 | 6 kgf | 40 | X | X |

The aluminum alloy of the present invention has the strength, hardness, and other such mechanical properties required by its intended applications, and also has an excellent metallic gloss, allowing an aluminum alloy with outstanding decorative properties to be obtained. This alloy is particularly useful when applied to the fastener elements, stops, sliders, pull tabs, and other such constituent members of a slide fastener, or to snap buttons, ordinary buttons, and

What is claimed is:

1. An aluminum alloy with excellent decorativeness, having a composition represented by the general formula $Al_aMg_bMn_cCr_d$, wherein b, c, and d are, in mass percentage, $3.0 \leqq b \leqq 5.6$, $0.05 \leqq c \leqq 1.0$, $0.05 \leqq d \leqq 0.7$, $c+d>0.2$, and a is the balance with unavoidable impurity elements optionally being contained, wherein a matrix of the aluminum alloy is a structure substantially composed of an aluminum solid solution, in which no β-phase is present, and wherein the aluminum alloy contains no compound having a particle size of greater than 5 μm.

2. The aluminum alloy with excellent decorativeness according to claim 1, wherein b, c, and d are, in mass percentage, $4.3 \leqq b \leqq 5.2$, $0.05 \leqq c \leqq 0.7$, $0.05 \leqq d \leqq 0.5$, and $c+d>0.2$.

3. The aluminum alloy with excellent decorativeness according to claim 2, wherein b, c, and d are, in mass percentage, $4.5 \leqq b \leqq 5.0$, $0.2 \leqq c \leqq 0.7$, $0.1 \leqq d \leqq 0.3$, and $c+d>0.2$.

4. The aluminum alloy with excellent decorativeness according to claim 1, wherein $c+3.2d \leqq 1.25$.

5. The aluminum alloy with excellent decorativeness according to claim 1, wherein the aluminum alloy contains compounds having an average particle size of 200 nm to 5 μm and precipitates having a particle size of no more than 100 nm.

6. The aluminum alloy with excellent decorativeness according to claim 1, wherein an anodic oxide film formed on the aluminum alloy by anodizing has a lightness of at least 55, as indicated by an L* value, which is a lightness defined in JIS Z 8729.

7. The aluminum alloy with excellent decorativeness according to claim 1, wherein the aluminum alloy has a hardness Hv of at least 125.

8. The aluminum alloy with excellent decorativeness according to claim 1, wherein the aluminum alloy has a cold workability of at least 55% in terms of fractional reduction in cold upsetting height.

9. An aluminum alloy with excellent decorativeness, wherein the alloy according to claim 1 is used for at least one slide fastener constituent member selected from the group consisting of elements, stoppers, a pull tab, and a slider.

10. An aluminum alloy with excellent decorativeness, wherein the alloy according to claim 1 is used for at least one selected from the group consisting of snap buttons, ordinary buttons, and clasps.

* * * * *